United States Patent [19]

Damvig

[11] Patent Number: 4,745,664

[45] Date of Patent: May 24, 1988

[54] LOCK FOR SECURING A MARK ESPECIALLY ONTO A TEXTILE ARTICLE

[75] Inventor: Leif Damvig, TÅstrup, Denmark

[73] Assignee: Antonson Security Denmark A/S, Roskilde, Denmark

[21] Appl. No.: 920,236

[22] Filed: Oct. 17, 1986

[51] Int. Cl.[4] ..... A44B 9/10

[52] U.S. Cl. ..... 24/155 R; 24/704

[58] Field of Search ..... 24/704, 150 R, 155 R, 24/155 BR, 155 RB

[56] References Cited

U.S. PATENT DOCUMENTS

| | | | |
|---|---|---|---|
| 863,543 | 8/1907 | Lomax . | |
| 924,238 | 6/1909 | Kan | 24/155 BR |
| 1,034,316 | 7/1912 | Slonaker | 24/155 R |
| 1,039,936 | 10/1912 | Hardie . | |
| 1,083,416 | 1/1914 | Sorensen et al. | 24/155 R X |
| 1,154,408 | 9/1915 | Kirshner | 24/155 BR |
| 1,157,835 | 10/1915 | Becker et al. | 24/155 BR |
| 1,472,681 | 11/1923 | Roy . | |
| 2,643,429 | 6/1953 | Wittstock . | |
| 2,923,042 | 2/1960 | Pliszczak et al. | 24/155 R X |
| 3,858,280 | 1/1975 | Martens . | |
| 3,953,990 | 5/1976 | Nagel . | |
| 4,005,507 | 2/1977 | Yamazaki | 24/150 R |
| 4,040,148 | 8/1977 | Fukumoto . | |
| 4,069,919 | 1/1978 | Fernbaugh . | |
| 4,088,228 | 5/1978 | Schwalbe . | |
| 4,104,622 | 8/1978 | Van Niel . | |
| 4,156,302 | 5/1979 | Van Niel . | |
| 4,221,025 | 9/1980 | Martens et al. . | |
| 4,305,266 | 12/1981 | Lockwood . | |
| 4,311,883 | 1/1987 | Kidney . | |
| 4,339,853 | 7/1982 | Lipschitz | 24/155 BR |

FOREIGN PATENT DOCUMENTS

| | | | |
|---|---|---|---|
| 67616 | 7/1892 | Fed. Rep. of Germany . | |
| 157150 | 5/1939 | Fed. Rep. of Germany . | |
| 3120971 | 2/1982 | Fed. Rep. of Germany . | |
| 21713 | 3/1905 | Sweden | 24/155 R |
| 468580 | 7/1937 | United Kingdom . | |
| 2021675 | 12/1979 | United Kingdom . | |

*Primary Examiner*—Kenneth J. Dorner
*Assistant Examiner*—James R. Brittain
*Attorney, Agent, or Firm*—Willian Brinks Olds Hofer Gilson & Lione Ltd.

[57] ABSTRACT

The lock is preferably to be used for burglar alarms for marking articles for sale, and it comprises two members automatically interengaging when the first member is inserted into a cavity in the second member, a loose third member being positioned in said cavity. The locking effect is provided by the loose third member comprising one, optionally more inclined surfaces capable of being tangent to and sliding along a corresponding inner wall in the cavity of the second member. The cavity of the second member is pointed upwards, i.e., towards the inlet opening. A spring is provided below the loose third member, and this spring presses as a consequence of the inclined wall the third member upwards and towards the first member.

7 Claims, 6 Drawing Sheets

LOCK FOR SECURING A MARK ESPECIALLY ONTO A TEXTILE ARTICLE

FIELD OF THE INVENTION

The present invention relates to a lock preferably for a burglar alarm for marking articles for sale, said lock comprising two members automatically interengaging when one member is inserted into a cavity in the other member, whereby said first member comprises a rod-shaped body, the inserting end of which is completely or partially pointed, said body engaging a third member loosely inserted into the cavity in the second member.

BACKGROUND ART

When ensuring articles for sale against burglary it is important that the markers are easy to mount on the articles for sale and only can be removed by an authorized person such as a shop assistant. The available markes are encumbered with the problem that the first member for instance shaped as a solid drawing pin sometimes can be pulled out of the lock merely by subjecting the head of the "drawing pin" to an upward pull, cf. for instance U.S. Pat. No. 3,858,280.

SUMMARY OF THE INVENTION

Consequently, the object of the invention is to provide a lock which is simple and inexpensive to manufacture and which is easy to open by authorized persons by means of special apparatuses, but which is difficult to open without said special apparatuses.

According to the invention the third member is provided with one or more inner surfaces capable of being tangent to and cooperating with corresponding inner surfaces on the second member, these surfaces being inclined upwards and inwards when seen in a vertical sectional view through the lock with the inlet of the cavity facing upwards, whereby the cavity is pointed upwards towards the inlet of the cavity and whereby a spring such as a flat spring with an upward elastic force is situated in the cavity below the loosely positioned third member.

In this manner a locking effect is obtained between the two members. When the first member is inserted into the cavity of the second member, said first member presses the third, loosely positioned member slightly aside and a short distance downwards whereafter the point of the first member passes the third member. The spring in the bottom implies that the third member does not fall into the bottom of the cavity but instead is pressed upwards towards the top of the cavity pointed upwards. If it is tried to pull out the first member again, a friction between the first member and the third member implies that said first member is pulled upwards too and thereby inwards as a consequence of the inclined surfaces. In this manner the third member fastens on additionally to the first member, and any upward pull fixes only the first member additionally. The lock can only be released by the inner loose third member being pressed downwards against the force of the spring therebelow.

The third member may advantageously be made of a magnetizable material and the second member may be made of a nonmagnetizable material such as plastics. In this manner the lock can be released by positioning the marker over a suitably strong magnet attracting the third member, whereby the magnet must be so strong that it can overcome the spring force.

The lock may, however, also be released in another manner. The top side of the second member may be completely or partially provided with hidden openings allowing the third member to be pressed into the cavity by means of an implement in such a manner that the first member can be removed from the lock.

According to the invention the loosely positioned third member may be shaped as a disc with an inclined upward projection, one surface of which forms one of the cooperating surfaces. As a result, a simple embodiment is obtained suited for the manufacture of a magnetizable steel alloy. The inclined upward projection on the third member may be provided with a bending forming a barb, and the rim of this barb may towards the first member be shaped as part of a circular arc with a radius fitting the radius of the rod-shaped body of the first member. The rod-shaped body of the first member may advantageously comprise a notch forming a cut cooperating with the rim shaped as a circular arc of the projection. In this manner an efficient engagement of the first and the third member is ensured.

The second member may comprise two untrasonically welded plastic portions, viz. an upper portion and a lower portion, and the lower portion may be cast with an upwardly inclined plastic flap forming the spring supporting the loosely positioned third member, whereby a very simple and inexpensive manufacture is rendered possible.

According to a second embodiment, the third member is shaped as two half truncated or pyramidal cones comprising axial bores in the opposting inner sides so that the rod-shaped body of the first member can be received between the two halves, and whereby the halves are provided on the inner sides of the bores with jaws capable of gripping about the first member. At the same time the inclined outer surfaces of the third member may slide against cooperating, touching surfaces on the inner side of the second member.

BRIEF DESCRIPTION OF THE DRAWING

The invention will be described below with reference to the accompanying drawing, in which.

DESCRIPTION OF PREFERRED EMBODIMENTS

Figure 1:
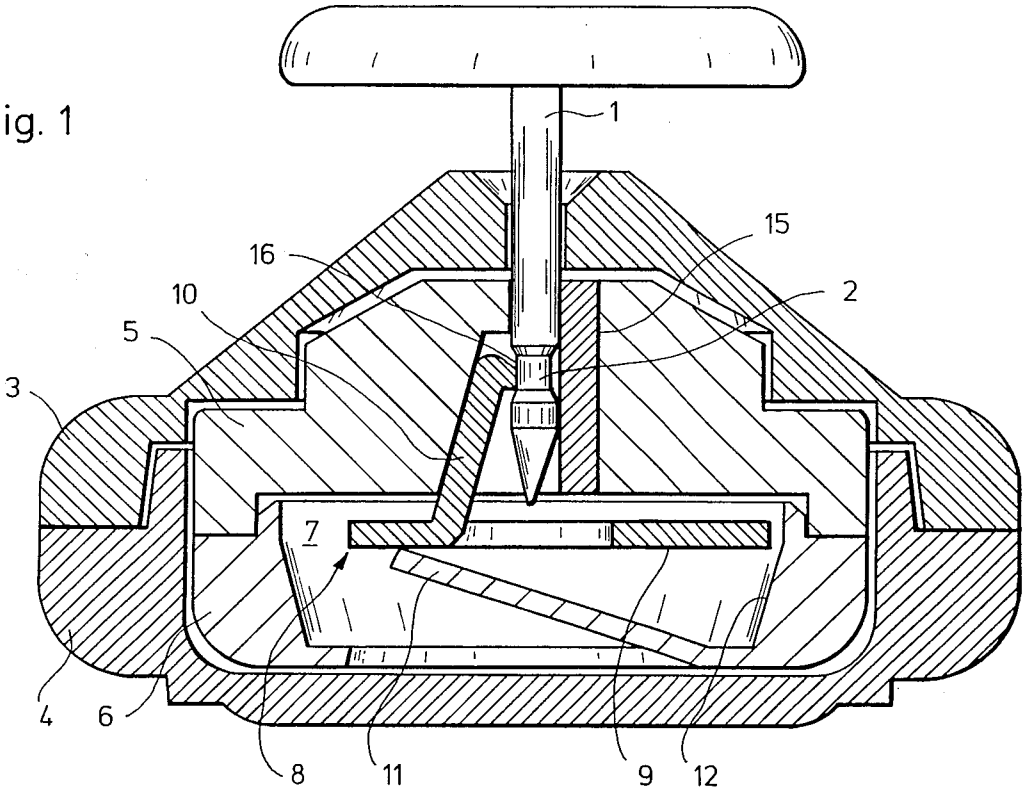
FIG. 1 is a sectional view through an embodiment of a lock according to the invention.

FIG. 1 illustrates a lock according to the invention. The lock comprises a first member 1 in the form of a steel pin with a plastic head. The pin is pointed in the inlet end and comprises a turned, narrowed portion 2. The lock furthermore comprises a second member 5, 6 inserted in a marker for a burglar alarm on an article for sale. The marker is preferably made of plastics in two portions 3, 4 with a cavity receiving the second member 5, 6. When the second member has been inserted, the two portions 3, 4 of the marker are assembled, for instance by ultrasonic welding into an inseparable unit. Alternatively, the marker may be cast or pressed about the second member of the lock. The second member of the lock comprises two portions 5, 6 preferably made of plastics. These two portions are also assembled by by ultrasonic welding and surround a cavity 7. A movable member 8 is positioned in this cavity. This movable member is a disc 9 with a pressed projection or flap 10 bent at its upper end to form a barb which can be directed towards the first member.

Figure 2:
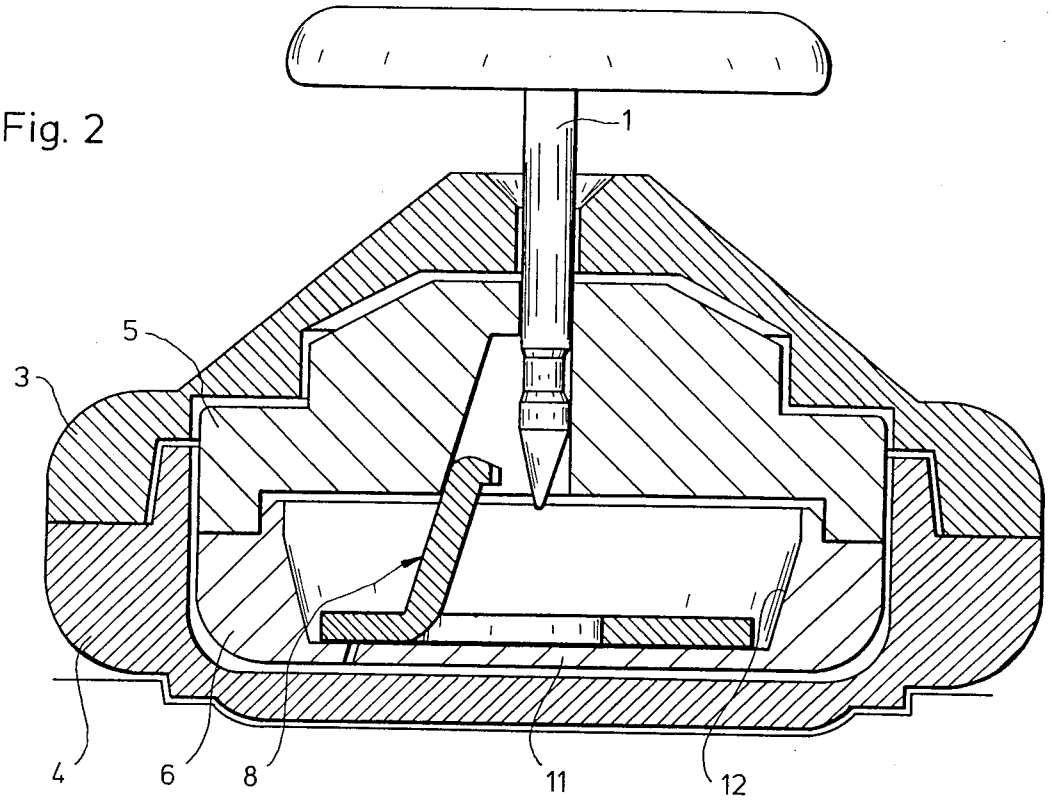
FIG. 2 is a sectional view corresponding to FIG. 1, where the lock is opened.

In the preferred embodiment the disc 9 is made of a hardened and magnetizable steel. The lower portion 6 of the second member is shaped during the casting with a pressed flap 11 forming a spring in the bottom of the lock. The spring presses the movable disc 9 upwards. The cavity 7 is greatest in the lower portion 6 of the second member, where both the loose, movable disc 9 and the spring 11 can be positioned. The cavity is so high that the disc 9 with the projection 10 can be pressed a substantial distance downwards through a suitably strong downward influence, said distance almost corresponding to half the length of the upward projection 10. The bottom of the cavity is insignificantly greater than the disc. As illustrated in FIG. 2, a displacement of the third member along the sliding surface on the projection 10 implies that the disc is carried into the bottom of the lock. The side surface 12 of the lower portion of the second member facing the cavity is in the illustrated embodiment provided with the same inclination as the upward projection of the third member. To the right in FIG. 1, the disc 9 is of such an extent that it almost touches the above side surface. When the third member is pressed downwards, e.g. when subjected to the field of a magnet, the disc is displaced a short distance to the left and released from the first member, cf. FIG. 2. The uppermost portion of the cavity 7 can receive the upward projection 8 of the third member and comprises an inclined, planar or conical wall so that the cavity 7 is pointed upwards. The projection 10 may comprise a planar side or a curved surface such as for instance a circular, cylindrical or conical surface, and this surface is tangent of the inner wall of the upper portion of the second member. This inner wall may be an inclined planar wall, but it may also be provided with a curvature. It is essential that the curvature allows the two surfaces to slide against one another in order to release the first member.

When the marker is to be secured in an article, the steel pin 1 of the first member is stuck through the article, e.g. in a sewing or a seam in a garment and pressed into an opening in the uppermost portion of the second member and further into the cavity downwards and past the projection 10. As a result, the disc 9 with the projection 10 is pressed a short distance downwards against the force of the spring 11. The projection 10 fastens fixedly to the pin 1 of the first member, the pin thereby being retained. Attempts of pulling out the first member 1 imply that the pin transfers the movement to the projection 10 and the disc 9. The inclined surface of the projection 10 and the corresponding surface on the upper portion 5 of the second member now imply that the projection is pressed even more firmly onto the pin of the first member and the cavity restricts the movement of the disc 9 and the projection upwards and thereby the movement of the first member. Opposite the inclined surface in the upper portion of the second member, the second member may be reinforced by an extra hard wall 15, e.g. of light metal. In this manner this wall is prevented from giving in to the pressure it can be subjected to if one tries to wriggle the first member so as to tear it off. The pin or the rod 1 of the first member may be a completely smooth rod, but it is preferably provided with circumferential grooves or narrowings engaging the projection 10 of the third member.

Figure 3:
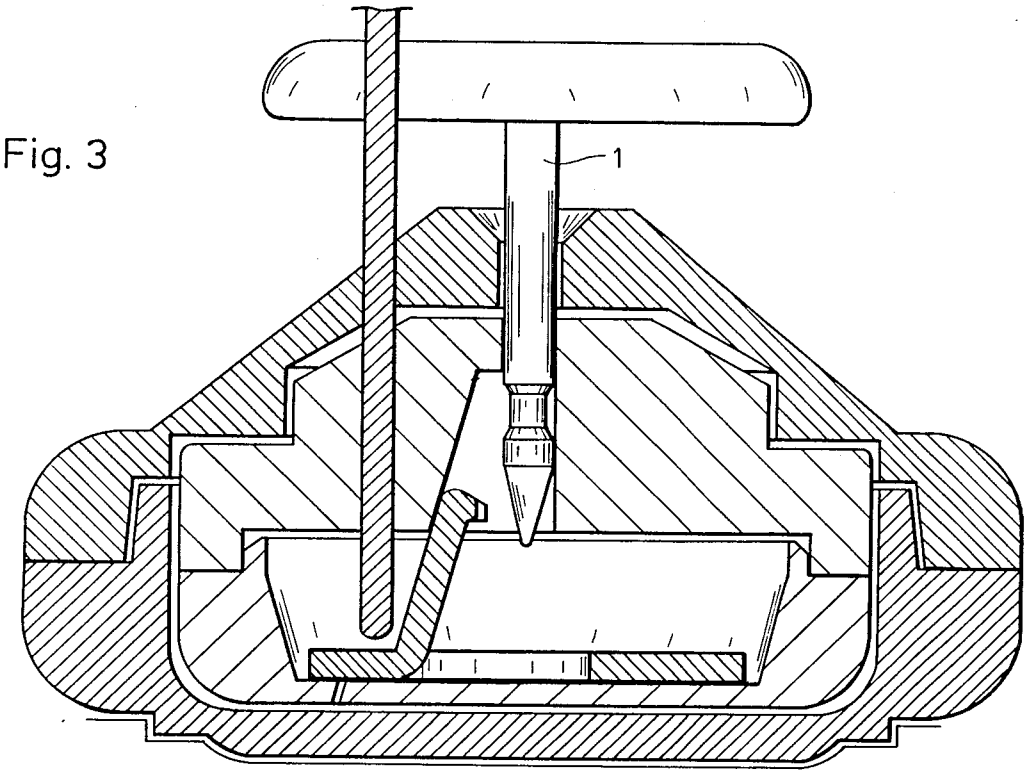
FIG. 3 illustrates a lock with openings for an implement for releasing the lock.

The lock is released by the third member, i.e. the disc 9 with the projection 10, being pressed or pulled downwards against the force of the spring 11. This procedure can be carried out by positioning the marker over a magnet, the magnetic field of which pulls down the steel disc 9. One or optionally several compound cobalt magnets may be used as magnet. As an alternative, the lock may be opened by inserting a needle 21 or a U-shaped hoop downwards into one or two openings provided for this purpose in the upper portions 3, 5 in such a manner that the disc 9 can be pressed downwards as indicated in FIG. 3. Such openings should be shaped as discrete as possible and for instance be covered by a mark as an insurance against burglary.

Figure 4:
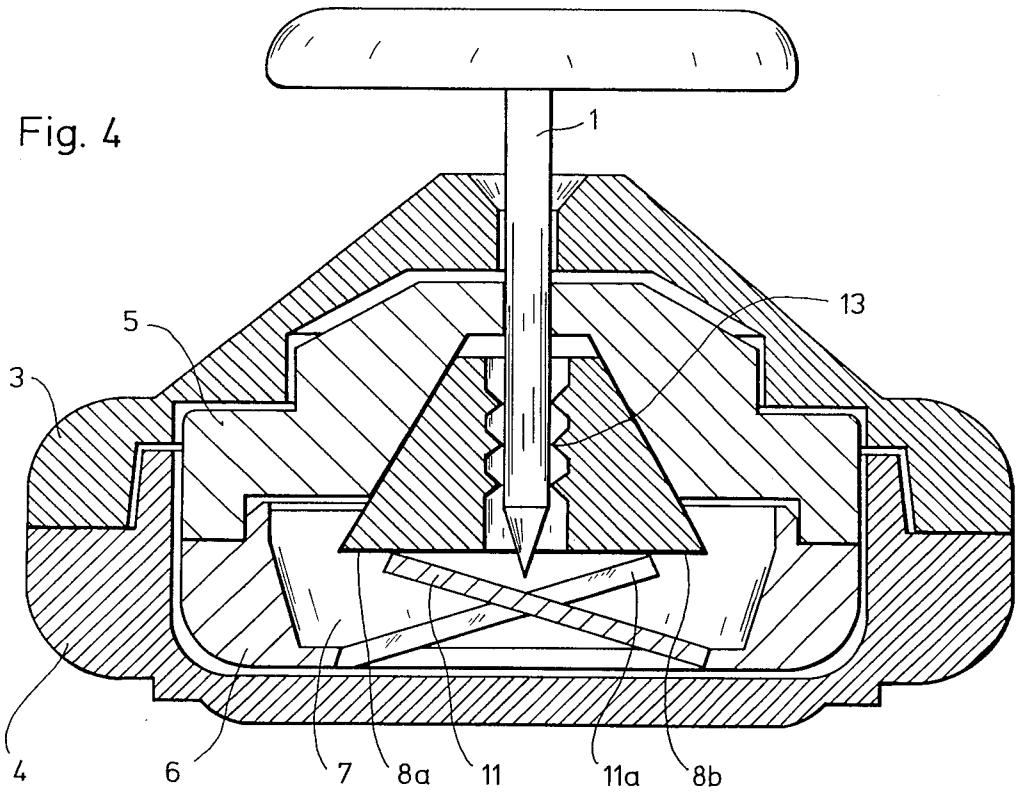
FIG. 4 is a sectional view through a second embodiment of a lock according to the invention.

FIG. 4 illustrates a second embodiment according to the invention. The same reference numerals have been used in the previous Figures. The movable member is shaped as a two-piece or truncated cone 8*a*, 8*b*, and on the inner side of each half opposing jaws 13 are provided. The Figure illustrates three pairs of jaws, but this number may, of course, vary. The inclined surface of the cone may slide on corresponding inclined surfaces 14 on the inner side of the cavity in the upper portion 5 of the second member. The cone is supported by two springs 11, 11*a* in the form of cast upward plastic "flaps". One of the springs 11*a* is fork-shaped and positioned symmetrically on each side about the spring 11. Instead of the cast plastic flaps, a helical spring may be used. The locking effect corresponds completely to the effect described in the first example. When the pin 1 is pulled out, the two cone halves follow said pin a short distance and fasten additionally thereon and thereby retain the pin. The cone angle may be varied in response to the materials used.

According to a particularly advantageous embodiment, the resilient flap 11 has been replaced by a substantially U-shaped tongue 19 communicating with the member 6 in two points 17. This tongue presses the disc 9 with the projection 10, upward in the same manner as the flap 11. As a consequence of the broader support along the rectilinear rim 20 of the U-shaped tongue, the disc 9 cannot tilt transversely to the longitudinal axis of the U. Furthermore, the U-shaped tongue cannot be hit and damaged by a steel pin 1.

Figure 5:
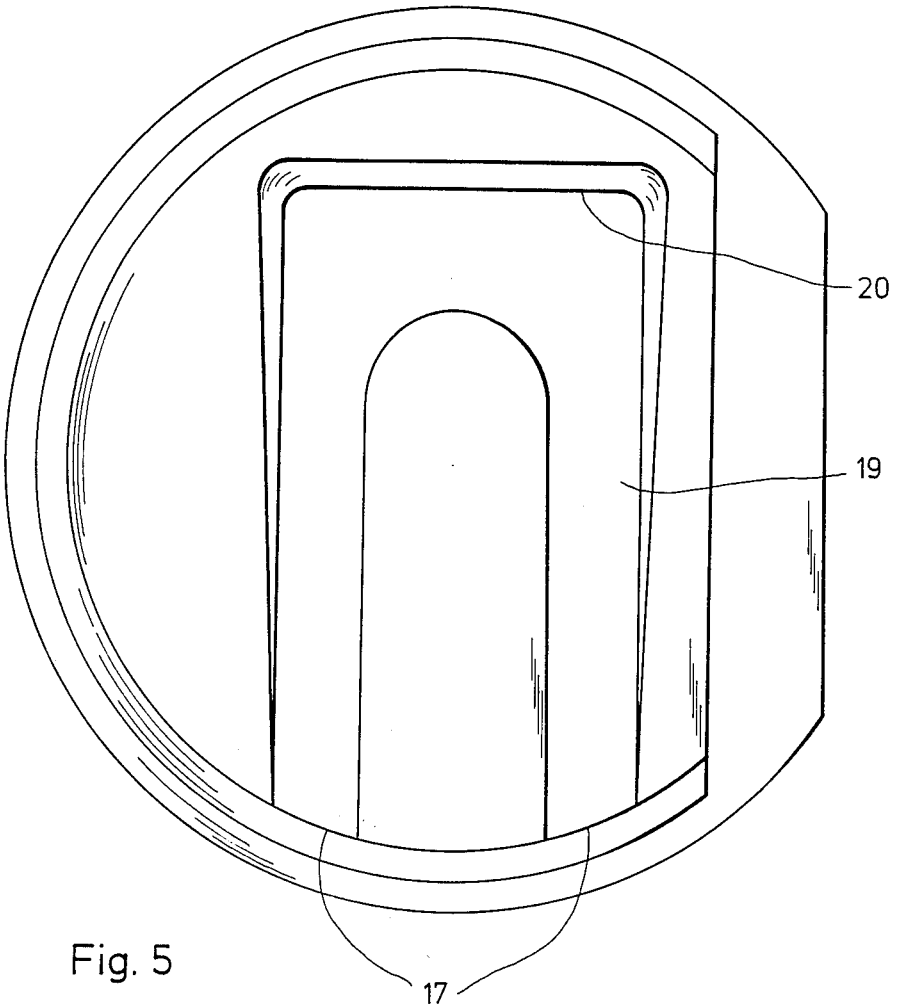
FIG. 5 illustrates the V-shaped resilient member pressing a disc with a locking pin upwards.
Figure 6:
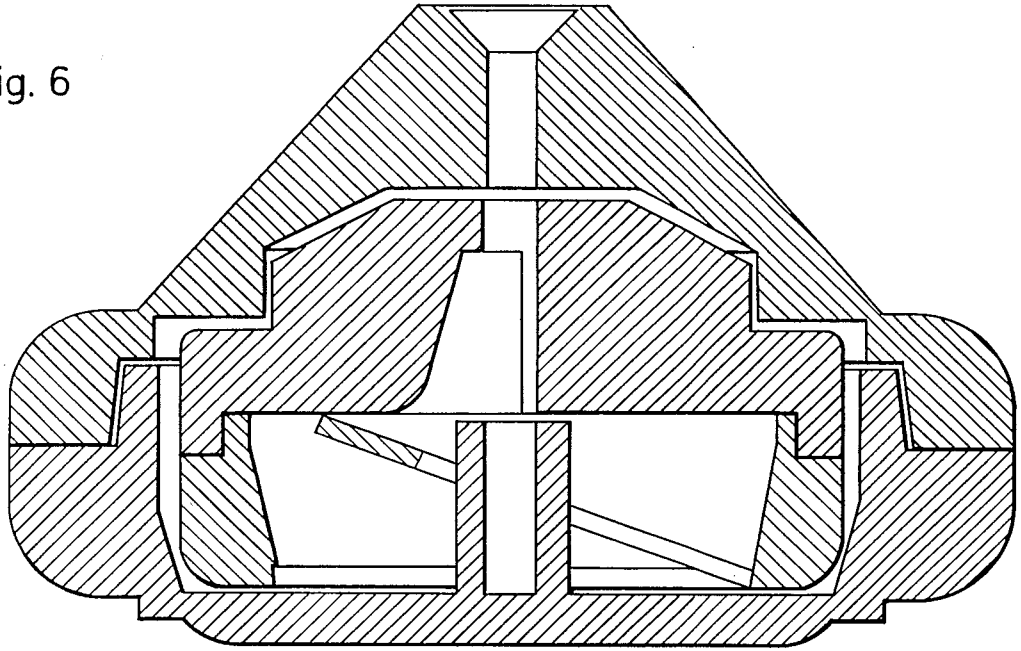
FIG. 6 illustrates a lock with bearing sleeve for the inserted tap.

In order to avoid that the pin is inserted askew into the lock a bearing sleeve 22 advantageously can be provided at the bottom of the enveloping plastics, FIG. 6. This bearing sleeve serves for receiving the pin during insertion and can for instance be formed integral with the enveloping material. The bearing sleeve is led through an oblong opening in the remotest flap. The flap may be shaped as shown in FIG. 5.

What is claimed is:

1. A lock preferably for an alarm for marking articles for sale, said lock comprising first and second members automatically interengaging when one member is inserted in a cavity in the other member, whereby said first member comprises a rod-shaped body, the inserting end of which is completely or partially pointed, a third member loosely inserted in the cavity in the second member, said third member comprising one or more inner surfaces capable of being tangent to and cooperating with corresponding inner surfaces on the second member, these surfaces further being inclined upwards and inwards when seen in a vertical sectional view through the lock with the inlet of the cavity facing upwards, whereby the cavity is pointed upwards towards the inlet of the cavity and whereby a spring with an upward elastic force is situated in the cavity below the loosely positioned third member, said second member being of a non-magnetizable material and said third member being of a magnetizable material to be attracted by a magnet and defining at least one projection for engaging the rod-shaped body, said projection being formed as a one piece, integral part of the third member, the second member comprising an upper non-magnetic portion and a lower non-magnetic portion, the lower portion being cast with an upwardly inclined flap forming the spring below the loosely positioned third member.

2. A lock as claimed in claim 1, wherein the third member is shaped as a disc with the projection pressed up from the disc.

3. A lock as claimed in claim 2, wherein the projection is provided at the top with a barb defining a rim, the rim of the barb towards the first member shaped as part of a circular arc with a radius fitting the radius of the rod-shaped body of the first member.

4. A lock as claimed in claim 3, wherein the rod-shaped body of the first member defines a notch forming a cut cooperating with the rim shaped as a circular arc of the projection.

5. A lock as claimed in claim 1, wherein a bearing sleeve is arranged at the bottom of the lock for receiving the pin to be inserted into the lock , the bearing sleeve being formed integral with the lock.

6. A lock as claimed in claim 1 wherein the inclined flap is substantially U-shaped.

7. A lock as claimed in claim 6 wherein the upper and lower portions are formed of plastic and are ultrasonically welded together.

* * * * *